US011524246B2

(12) United States Patent
Mayer et al.

(10) Patent No.: US 11,524,246 B2
(45) Date of Patent: Dec. 13, 2022

(54) TOY FIGURINE

(71) Applicant: Mattel, Inc., El Segundo, CA (US)

(72) Inventors: Louis-Philippe Mayer, Los Angeles, CA (US); Ronald M. Asbach, Grand Island, NY (US); Andrew Sik lun Wong, Torrance, CA (US); Peter John Simpson, Jakarta (ID)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 17/187,953

(22) Filed: Mar. 1, 2021

(65) Prior Publication Data

US 2022/0274030 A1 Sep. 1, 2022

(51) Int. Cl.

| | |
|---|---|
| ***A63H 3/00*** | (2006.01) |
| ***A63H 9/00*** | (2006.01) |
| ***A63H 3/46*** | (2006.01) |

(52) U.S. Cl.

CPC ..... *A63H 3/46* (2013.01); *A63H 3/00* (2013.01); *A63H 9/00* (2013.01)

(58) Field of Classification Search

CPC ... A63H 3/00; A63H 3/36; A63H 9/00; B29C 65/00; B29C 65/02; B29C 65/06; B29C 65/40

See application file for complete search history.

(56) References Cited

U.S. PATENT DOCUMENTS

| | | | | |
|---|---|---|---|---|
| 1,509,604 | A | | 9/1924 | Myers |
| 1,690,778 | A | | 11/1928 | Ford |
| 3,059,377 | A | | 10/1962 | Brown |
| 3,579,902 | A | | 5/1971 | Osborne |
| 3,783,554 | A | | 1/1974 | Shapero |
| 3,816,957 | A | | 6/1974 | Nakajima |
| 4,205,785 | A | | 6/1980 | Stanley |
| 4,334,385 | A | | 6/1982 | Melin |
| 4,571,209 | A | * | 2/1986 | Manning ..... A63H 3/46 446/376 |
| 4,595,378 | A | | 6/1986 | Sweet |
| 4,657,519 | A | * | 4/1987 | Kobayashi ..... A63H 3/46 446/376 |
| 4,714,446 | A | * | 12/1987 | Lee ..... A63H 3/36 446/361 |
| 4,775,352 | A | | 10/1988 | Curran |
| 4,919,987 | A | * | 4/1990 | Manner ..... B29C 65/0672 428/474.7 |

(Continued)

OTHER PUBLICATIONS

Office Action for Chinese Patent Application No. 202220429982.6, dated Aug. 1, 2022, 2 pages.

*Primary Examiner* — John A Ricci

(74) *Attorney, Agent, or Firm* — Edell, Shapiro & Finnan, LLC

(57) ABSTRACT

A toy assembly comprising a first section and a second section coupled to the first section. The first section includes a plurality of first section members positioned on an inner side of the first section. The second section includes a plurality of second section members positioned on an inner side of the second section. The plurality of second section members are heat welded directly to the plurality of first section members without any additional welding or filler material. The first section and the second section are solely held together by the heat welded first section members and second section members.

18 Claims, 8 Drawing Sheets

(56) References Cited

U.S. PATENT DOCUMENTS

| | | | | |
|---|---|---|---|---|
| 4,997,500 | A * | 3/1991 | Arnett | B29C 66/126 156/92 |
| 5,480,341 | A | 1/1996 | Plakos | |
| 5,547,413 | A | 8/1996 | Murray | |
| 6,537,131 | B1 | 3/2003 | Larian | |
| 6,568,986 | B2 | 5/2003 | Kobayashi | |
| 6,582,272 | B1 | 6/2003 | Nelson | |
| 6,641,895 | B1 | 11/2003 | Adams | |
| 6,790,117 | B2 | 9/2004 | Ruiz Gonzalez | |
| 7,913,968 | B2 | 3/2011 | Sullivan | |
| 8,308,524 | B2 | 11/2012 | deFelice et al. | |
| 8,333,634 | B2 | 12/2012 | Norman | |
| 9,174,138 | B2 | 11/2015 | Norman | |
| 9,636,600 | B2 | 5/2017 | Rudisill | |
| 2001/0046828 | A1 | 11/2001 | Morris | |
| 2004/0253901 | A1 | 12/2004 | Donahue | |
| 2006/0234599 | A1 | 10/2006 | Mo | |
| 2007/0264901 | A1 | 11/2007 | Sisamos | |
| 2007/0264902 | A1 | 11/2007 | Ellman | |
| 2009/0318053 | A1 | 12/2009 | Tager | |
| 2010/0041300 | A1 | 2/2010 | Bevirt | |
| 2010/0041301 | A1 | 2/2010 | Phillips | |
| 2010/0210171 | A1 | 8/2010 | Chan | |
| 2010/0210173 | A1 | 8/2010 | Maggiore | |
| 2010/0216367 | A1 | 8/2010 | Kasahara | |
| 2011/0114031 | A1 | 5/2011 | Mann | |
| 2012/0329361 | A1 | 12/2012 | Buckley | |
| 2014/0094084 | A1 | 4/2014 | Lambrakis | |

* cited by examiner

TOY FIGURINE

FIELD OF THE INVENTION

The present invention relates generally to toy assemblies, and in particular, body assemblies for toy figurines and dolls.

BACKGROUND OF THE INVENTION

The fabrication of toy figurines and dolls has evolved over time, reflecting shifting trends and consumer preferences, improvements in manufacturing processes, as well as changes in the materials available and used. Toy figurines are commonly assembled with different parts and sections screwed together. For toy figurines manufactured from a plastic material such as acrylonitrile butadiene styrene (ABS), fabrication of the toy figurine often involves solvent bonding/gluing two plastic halves together to form the body or torso of the toy figurine. The use of adhesives or glue to connect the two plastic halves provides the benefit of eliminating exterior assembly details associated with other conventional joining methods (e.g., screw holes).

However, when the plastic material is switched from acrylonitrile butadiene styrene (ABS) to a different material, difficulty or an inability to solvent bond/glue the components together may become an issue. For example, high-density polyethylene (HDPE) is inert to chemicals for solvent bonding and is also too soft to respond to the ultrasonic frequency for ultrasonic welding (the softness of the material absorbs the vibrational energy needed to generate the localized friction heat for melting the material).

Thus, there is a need for a novel toy figurine and related method of fabricating such a toy figurine that does not rely on solvent bonding/gluing the components together, but still provides a body or torso with no visible exterior assembly details.

SUMMARY OF THE INVENTION

A toy assembly, for instance a body assembly or torso of a toy figurine, as disclosed herein is formed from two main sections that are heat welded together for a clean aesthetic that hides its assembly details. This general construction eliminates the need for screws or adhesives—components which can affect the overall recyclability of a toy. Furthermore, the toy assembly can be fabricated from a wide range of polyolefin materials, such as high-density polyethylene (HDPE). Thus, the entire toy can be fabricated using a single material, such as a recyclable plastic, to create an easily recyclable and environmentally conscious toy.

In one or more embodiments, the toy assembly comprises a first section and a second section coupled to the first section. The first section includes a plurality of first section members positioned on an inner side of the first section. The second section includes a plurality of second section members positioned on an inner side of the second section. The plurality of second section members are heat welded directly to the plurality of first section members without any additional welding or filler material. Furthermore, the first section and the second section are solely held together by the heat welded first section members and second section members. Preferably, the toy assembly is completely made of a single polyolefin material and does not include an adhesive or screw. In one instance, the toy assembly is made of a high-density polyethylene (HDPE).

In certain embodiments, the first section also includes an indentation positioned along the perimeter of the first section and the second section includes a protrusion positioned along the perimeter of the second section. The protrusion engages the indentation to form an overlap joint that aligns the second section with the first section. Additionally or alternatively, the first section can include a plurality of alignment sockets on the inner side of the first section and the second section can include a plurality of alignment posts on the inner side of the second section. The plurality of alignment posts are received by the plurality of alignment sockets to align the second section with the first section.

In one or more other embodiments, a body assembly for a toy figurine is provided. The body assembly comprises a first section and a second section. The first section includes a plurality of first section bosses and alignment sockets positioned on an inner side of the first section. The second section is coupled to the first section and includes a plurality of second section bosses and alignment posts positioned on an inner side of the second section. The plurality of first section bosses are directly heat welded to the plurality of second section bosses without adding any welding material to the joint (e.g., without a filler material or any other type of additional material). Furthermore, the alignment posts are engaged with the alignment sockets but are not heat welded to the alignment sockets.

In certain embodiments, the plurality of first section bosses are positioned proximate the perimeter of the first section and the plurality of second section bosses are positioned proximate the perimeter of the second section. At least one of the alignment posts and at least one of the alignment sockets are positioned within an upper portion, a middle portion, and a lower portion of the body assembly. In some embodiments, the body assembly further includes a pair of arms movably retained between the first section and second section. A hip connector may also be retained between the first section and second section and a pair of legs are movably coupled to the hip connector. In one instance, the hip connector includes a pair of annular (e.g., donut-shaped) ball joints and each leg is movably coupled to one of the annular (e.g., donut-shaped) ball joints.

In one or more other embodiments, a method of fabricating a toy assembly is provided. The method comprises providing a first section and a second section. The first section has a plurality of first section members positioned on an inner side of the first section and the second section has a plurality of second section members positioned on an inner side of the second section. A top portion of the first section members and the second section members is heated and the first section and the second section are then brought together such that the first section members are heat welded to the second section members and the first section is permanently coupled to the second section without adhesives or screws.

In certain embodiments, the first section includes an indentation positioned along the perimeter of the first section and the second section includes a protrusion positioned along the perimeter of the second section. The step of bringing together the first section and the second section further includes engaging the indentation with the protrusion to align the first section with the second section. Additionally or alternatively, the first section can include a plurality of alignment sockets on the inner side of the first section and the second section can include a plurality of alignment posts on the inner side of the second section. In such embodiments, the step of bringing together the first section and the second section further includes inserting the alignment posts into the alignment sockets to align the first section with the second section.

Other objects, features, and advantages of the present invention will become apparent to those skilled in the art from the following detailed description. It is to be understood, however, that the detailed description and specific examples, while indicating some embodiments of the invention, are given by way of illustration and not limitation. Many changes and modifications within the scope of the invention may be made without departing from the spirit thereof, and the present invention includes all such modifications.

BRIEF DESCRIPTION OF THE DRAWINGS

Referring now to the drawings in which like reference numbers represent corresponding parts throughout:

FIG. 1A shows a front view of the body assembly and FIG. 1B shows a back view of the body assembly;

FIG. 2A shows a perspective view of the inner side of the front section. FIG. 2B shows the arms and legs positioned on the inner side of the front section;

FIG. 3A shows a perspective view of the inner side of the back section. FIG. 3B shows the arms and legs positioned on the inner side of the back section;

FIG. 4A shows a perspective view of the body assembly without the arms and legs. FIG. 4B shows a cross-sectional view of the body assembly of FIG. 1A along line 4B-4B.

DETAILED DESCRIPTION OF THE INVENTION

Figure 1A:
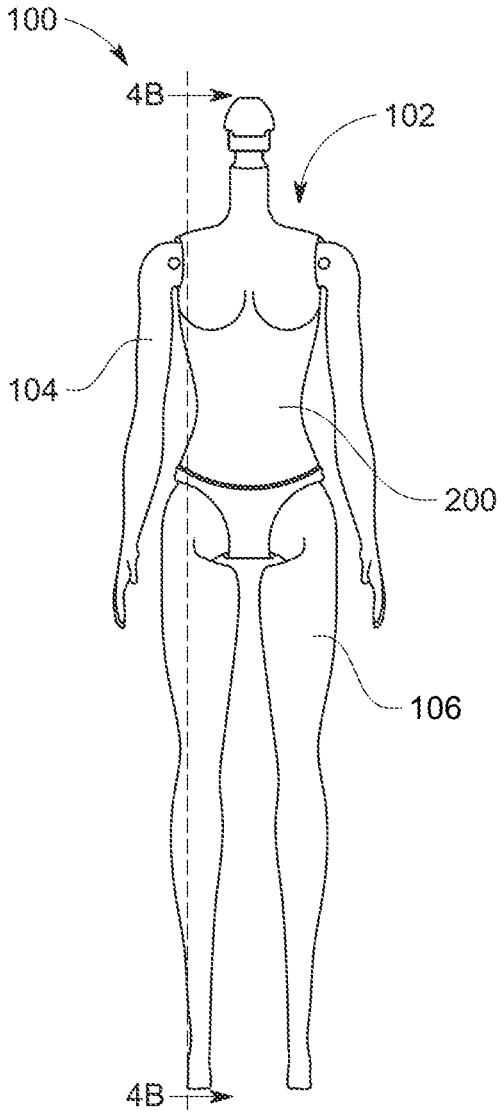
FIGS. 1A and 1B illustrate various views of a body assembly of a toy figurine, in accordance with an embodiment of the invention.
Figure 1B:
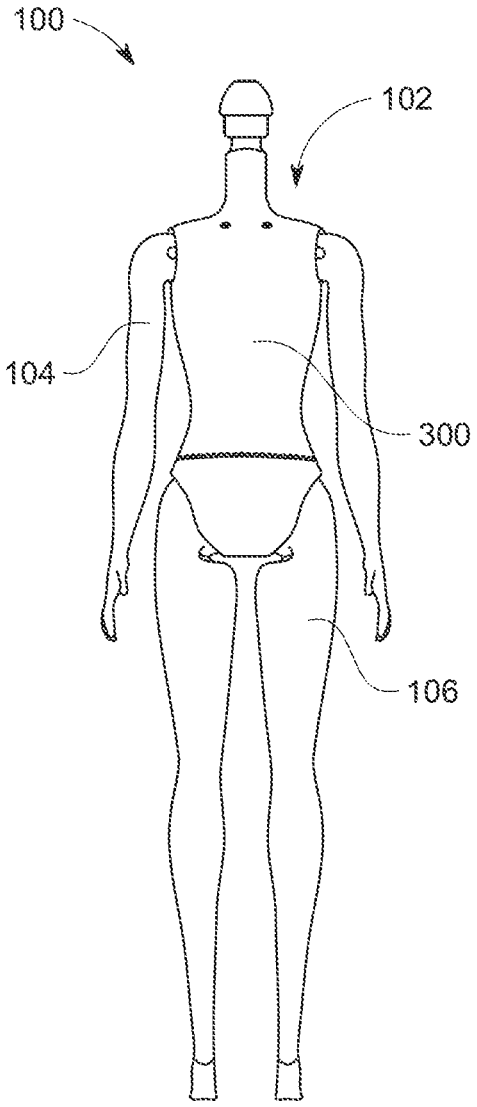

A toy assembly and a related method for fabricating the toy assembly are disclosed. FIGS. 1-4 set forth an illustrative example of a body assembly 100 for a toy figurine. As shown in FIGS. 1A and 1B, body assembly 100 includes a torso 102 with arms 104 and legs 106 moveably connected to torso 102. A head (not shown) is connected to body assembly 100 to complete the toy figurine. Torso 102 comprises two sectional halves, a front section 200 and a back section 300. Due to the method used to construct body assembly 100, which will be discussed in further detail herein, exterior assembly details such as screw holes are notably absent from the front and back of torso 102 for a clean and pleasing aesthetic. Body assembly 100 may be made of any plastic material, including materials and resins that are difficult to solvent bond or ultrasonically weld together such as high-density polyethylene (HDPE) and polypropylene copolymer (PPCO). In one preferred embodiment, body assembly 100 is fabricated from a post-consumer recycled high-density polyethylene (HDPE) or a bio/plant-based plastic.

Figure 2A:
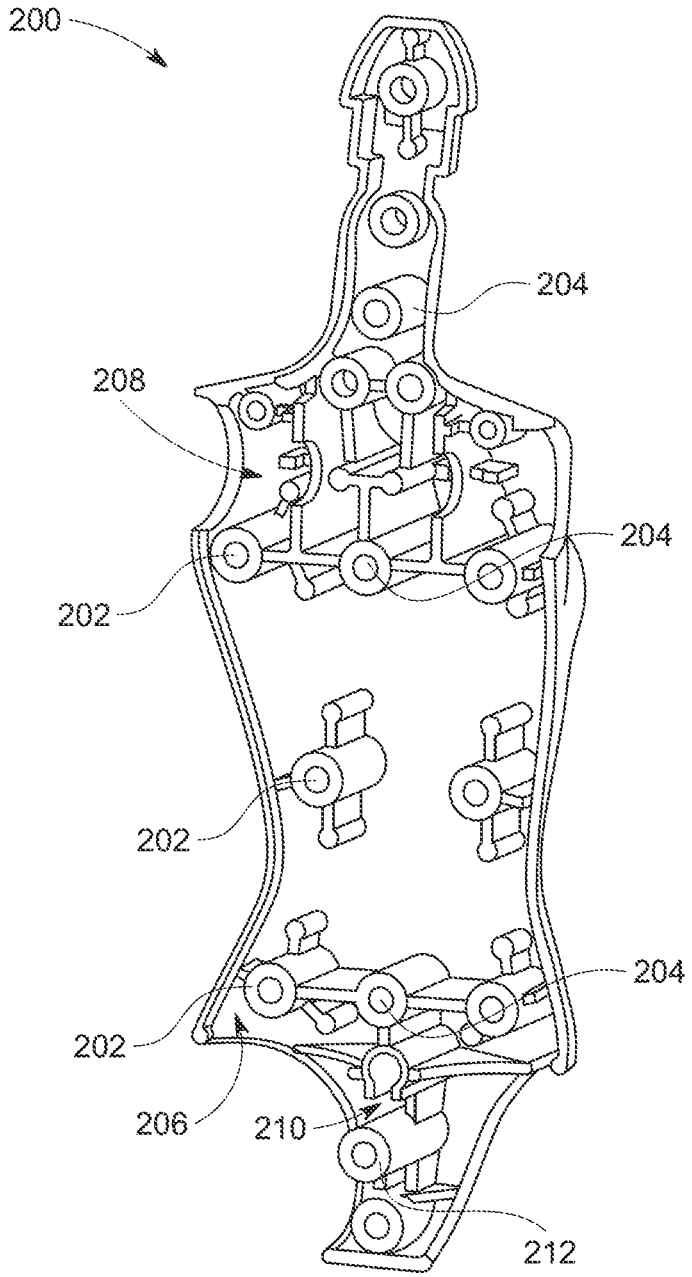
FIGS. 2A and 2B illustrate various views of a front section of the body assembly of FIGS. 1A and 1B, in accordance with an embodiment of the invention.
Figure 2B:
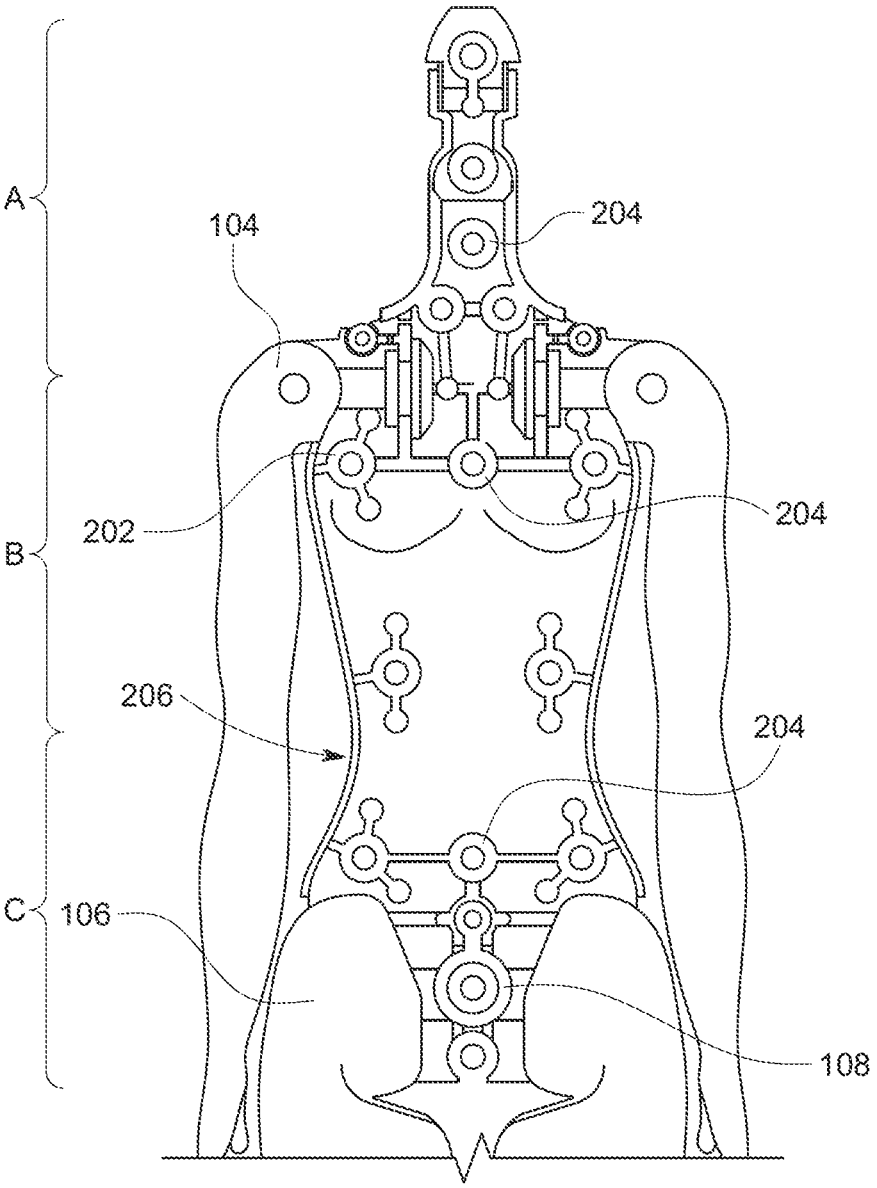

Referring now to FIGS. 2A and 2B, the inner side of front section 200 has multiple weldable members. In the exemplary embodiment illustrated, thirteen bosses 202 are positioned along the perimeter of the front section 200. Bosses 202 are positioned to be welded to corresponding bosses 302 on the inner side of back section 300 (see FIGS. 3A and 3B). Each boss 202 is cylindrically shaped with a hollow center. The tubular shape of bosses 202 provides an increased outer diameter (O.D.) size and related surface contact area for heat welding without a thick wall section (in contrast to a solid or non-hollow shape). Furthermore, the tubular shape allows bosses 202 to maintain a consistent wall thickness that is beneficial to the cooling of the bosses while in a mold (in contrast to shapes with corners or sections of increased thickness). In one or more embodiments, the nominal wall thickness of bosses 202 is 1.5 to 1.8 mm.

Further, three alignment sockets 204 are each located within a respective upper portion A, middle portion B, and lower portion C of torso 102 (see FIG. 2B). Together with the three alignment posts 304 of back section 300 (see FIGS. 3A and 3B), the engagement of alignment sockets 204 with alignment posts 304 aids in the alignment of front section 200 and back section 300 when the two sections are brought together to form torso 102. Additionally, alignment sockets 204 and alignment sockets 304 are positioned within different portions of torso 102 to help trap and secure arms 104 and hip connector 108 within torso 102.

In the exemplary embodiment illustrated, the alignment sockets 204 in upper portion A and middle portion B help retain arms 104. The alignment socket 204 in lower portion C helps retain hip connector 108. A different number of alignment sockets and corresponding alignment posts (e.g., 1, 2, 4 or more pairs of alignment sockets and posts) may be used depending on various factors such as the size of the torso, the amount of alignment necessary when coupling the front section to the back section, and the amount of reinforcement necessary to securely retain the appendages (e.g., arms, legs, hip connector) within the torso. Furthermore, in the exemplary embodiment illustrated, alignment sockets 204 are similarly sized and have the same hollow cylindrical shape as bosses 202. In other embodiments, the bosses and the alignment sockets may be any number of different shapes or sizes.

To further facilitate the alignment between front section 200 and back section 300, the perimeter of the inner side of front section 200 includes an indentation 206. When aligned with protrusion 306 of back section 300 (see FIG. 3B), indentation 206 and protrusion 306 form an overlap joint that acts to align front section 200 and back section 300. In certain embodiments, the body assembly does not include alignment sockets and only relies on the engagement of the indentation and protrusion of the front and back sections, respectively, for alignment. Alternatively, any other alignment features might be used in combination with one, both, or none of the two aforementioned alignment features (e.g., with an indentation and protrusion, posts and sockets, both, or neither). Additionally, front section 200 includes a pair of recesses 208 that allow arms 104 to be movably connected to torso 102. Hip connector 108 engages with a recess 210 and protrusion 212 on front section 200 and allows legs 106 to be movably connected to torso 102 via hip connector 108.

Figure 3A:
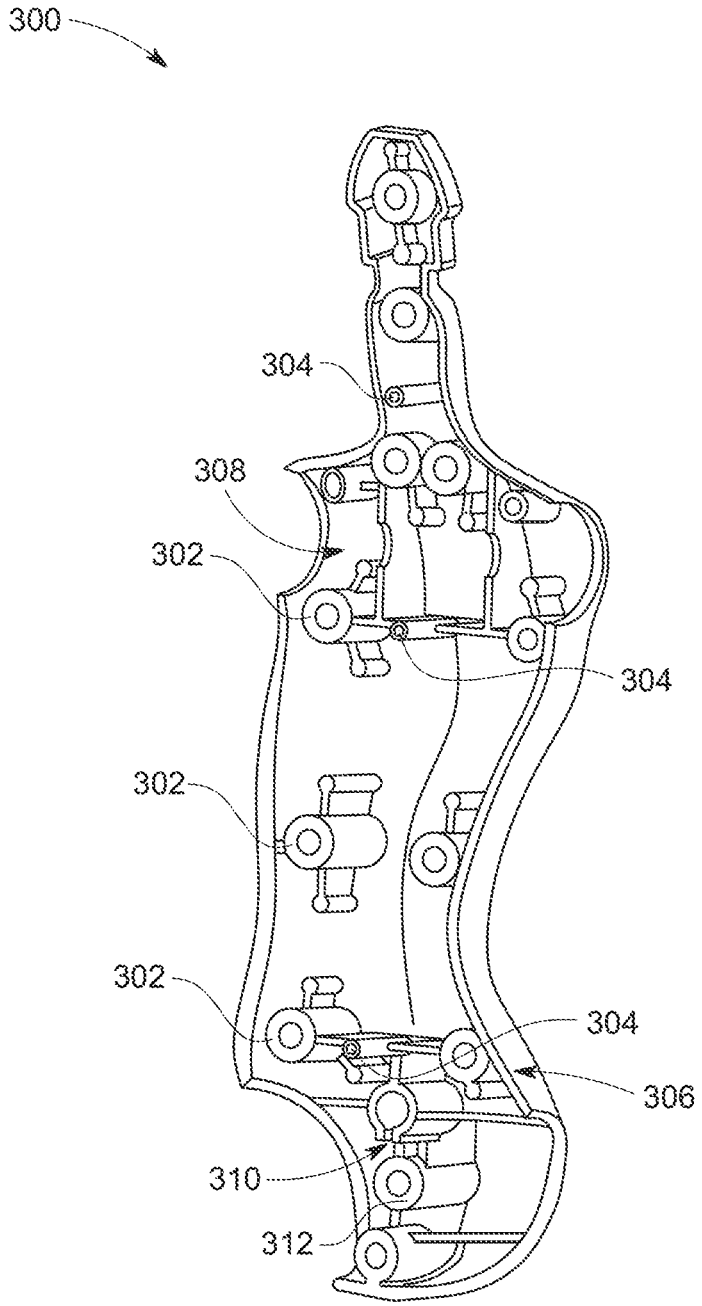
FIGS. 3A and 3B illustrate various views of a back section of the body assembly of FIGS. 1A and 1B, in accordance with an embodiment of the invention.
Figure 3B:
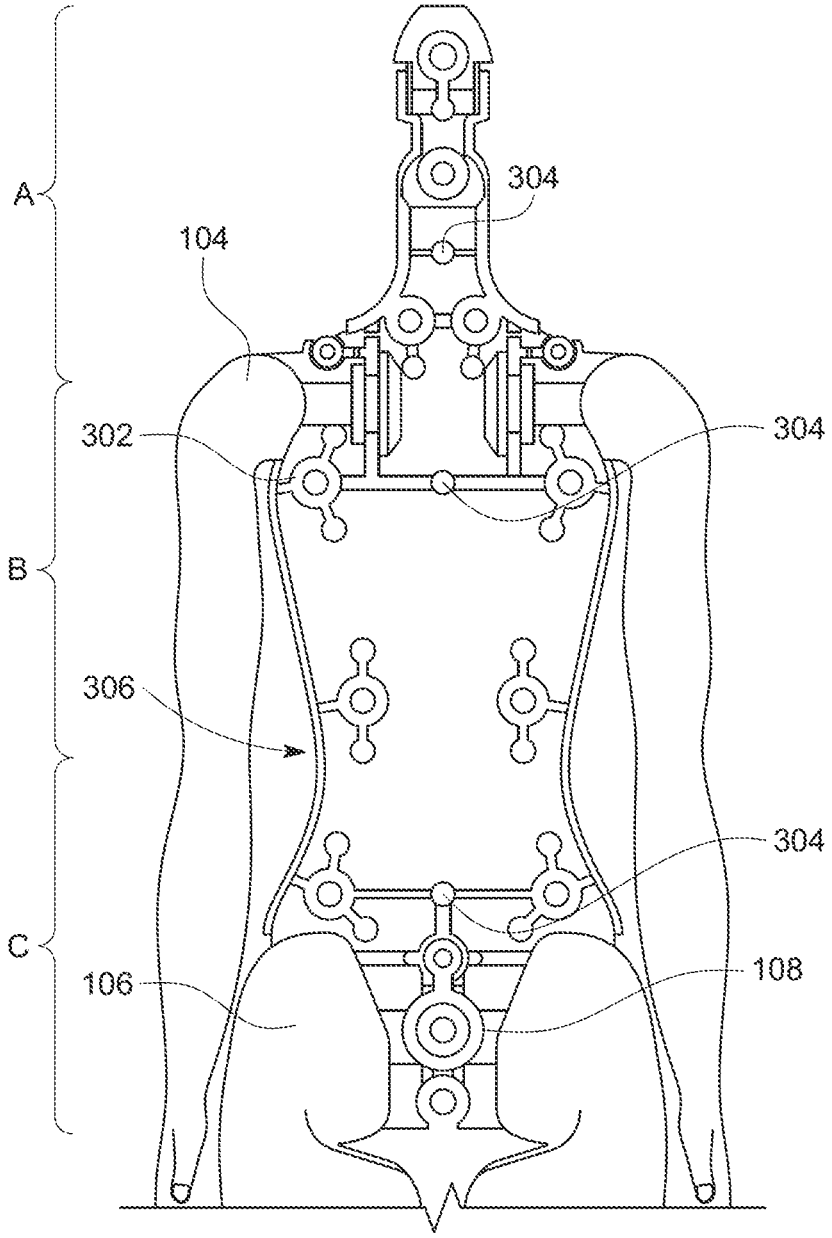

Referring now to FIGS. 3A and 3B, the inner side of back section 300 similarly has thirteen bosses 302 positioned along the perimeter of the back section 300. Bosses 302 are positioned to be heat welded to corresponding bosses 202 on the inner side of front section 200. Bosses 302 are also cylindrically shaped with a hollow center to have the same characteristics and advantages as described above for bosses 202. Instead of alignment sockets, three alignment posts 304 are each located within the respective upper portion A, middle portion B, and lower portion C of torso 102 (see FIG. 3B). Alignment posts 304 are sized to be inserted and received within corresponding alignment sockets 204 on the inner side of front section 200.

Figure 4A:
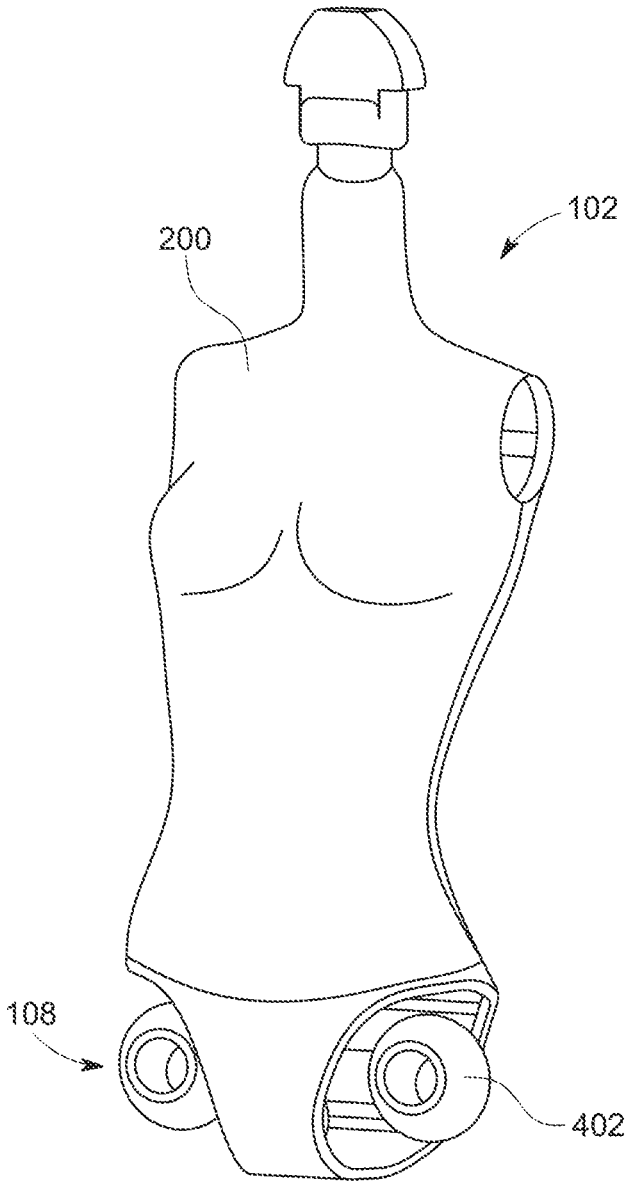
FIGS. 4A and 4B illustrate various views of the body assembly of FIGS. 1A and 1B, in accordance with an embodiment of the invention.

The perimeter of the inner side of back section 300 further includes a protrusion 306 that abuts indentation 206 of front section 200 when front section 200 and back section 300 are assembled together to form torso 102 (see, e.g., FIG. 4A). As described above, engaging alignment posts 304 and protrusion 306 respectively with alignment sockets 204 and indentation 206 helps ensure that front section 200 and back section 300 are correctly aligned when brought together. Back section 300 also includes a pair of recesses 308 for arms 104 and a recess 310 and protrusion 312 for engaging hip connector 108.

Figure 4B:
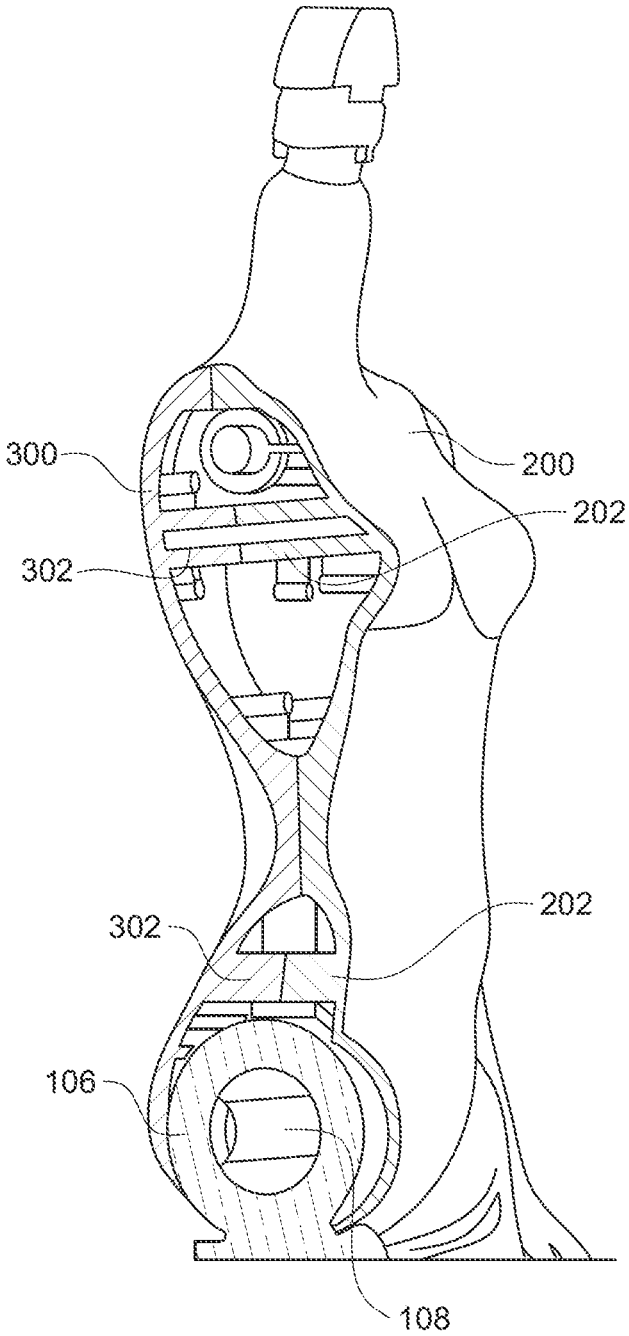

Referring now to FIGS. 4A and 4B, torso 102 is assembled by bonding bosses 202 of front section 200 to bosses 302 of back section 300. Bosses 202, 302 are joined together using hot gas or hot air welding (i.e., heat welding). Heated air is used to soften and melt the top mating surfaces of bosses 202, 302, which are then brought together to form a strong permanent bond. In comparison to conventional hot air/gas welding techniques that require a plastic welding/filler rod to join the two parts, bosses 202, 302 are heated and joined directly to each other without any extra heated material (i.e., without plastic welding/filler material).

The boss-to-boss hot air welding process described herein allows multiple bosses to be simultaneously heated in a controlled fashion for fast and easy fabrication of the body assembly. Bosses 202, 302 have an initial length that allows the mating surfaces to be deformed and squeezed out around the bosses as the bosses are joined together. In one exemplary implementation, the bosses include 0.25 mm of extra material length to be melted and deformed. Since bosses 202, 302 are located inside torso 102, any deformed material or mess resulting from the joining of the bosses is hidden and not visible from the outside of the body assembly. Hot air welded bosses 202, 302 eliminate the need for screws and other consumables that may be used in other joining methods. Furthermore, the welded bosses provide a strong and firm connection between front section 200 and back section 300 that allows arms 104 and legs 106 to be stably retained therein. In contrast, using male and female bosses and/or an adhesive to join the bosses together results in a comparatively much weaker bond.

Even though alignment sockets 204 are the same shape as bosses 202 in the exemplary embodiment illustrated, alignment sockets 204 are not hot air welded to alignment posts 304. Instead, alignment posts 304 are inserted and received within alignment sockets 204 as front section 200 and back section 300 are brought together. Additionally, protrusion 306 abuts indentation 206 to facilitate the alignment between front section 200 and back section 300. Hot air welding is similarly not applied along the perimeter of torso 102 because the heat can deform the defined shape and edge of torso 102. Therefore, front section 200 and the back section 300 are solely held together by the heat welded front section bosses 202 and back section bosses 302. That is, only boss-to-boss hot air welds couple the front section 200 to the back section 300.

As shown in FIG. 4A, front section 200 and back section 300 are contoured to provide openings that allow arms 104 and legs 106 to be connected to torso 102 respectively via recesses 208, 308 and hip connector 108. Hip connector 108 includes a pair of ball joints 402 that allow legs 106 to be movably connected to torso 102. Conventionally, hip connector ball joints are "C" shaped with a cutout that allows the ball joint to deform and snap-fit into a leg socket. However, materials such as HDPE have low elasticity (i.e., relaxes and deforms under stress/pressure and fails to return to its original shape), which affects its ability to form a tight snap-fit connection. Thus, ball joints 402 are instead annular (e.g., "donut" shaped with a cylindrical center cutout), which addresses the low elasticity of materials such as HDPE and provides a tight snap-fit connection with legs 106.

The hot air welded boss-to-boss construction described herein allows body assembly 100 to be fabricated from a wide range of polyolefin materials (e.g., polypropylene, polyethylene, polybutylene). In a preferred embodiment, the whole toy figurine (including the body assembly, head, and appendages) is made of a single recyclable and/or sustainable material such as post-consumer recycled high-density polyethylene (HDPE) or a bio/plant-based plastic. Furthermore, because the toy figurine does not include extraneous materials such as metal screws, adhesives or welding material that can affect the recycling process, the toy figurine can be easily recycled to reduce waste and resource consumption. That is, due to its composition and fabrication, the entire figurine may be recyclable.

Figure 5:
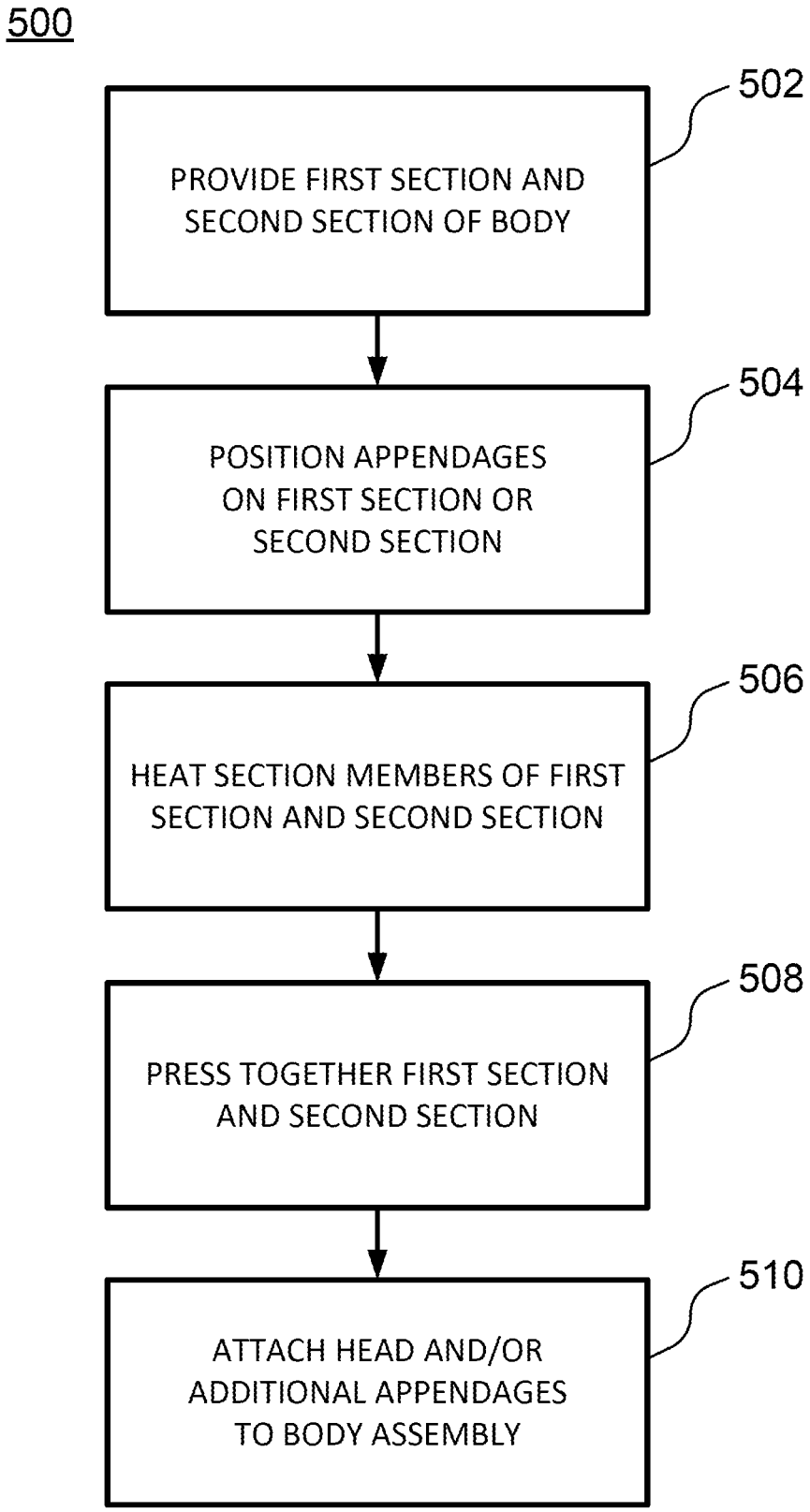
FIG. 5 illustrates an exemplary method of fabricating a toy figurine, in accordance with an embodiment of the invention.

FIG. 5 illustrates an exemplary method 500 for fabricating a toy figurine. The method begins at step 502, where a first section and a second section of the main body or torso for a toy figurine are provided. The first section includes weldable section members, such as bosses, on an inner side of the first section. The second section also includes weldable section members, such as bosses, on an inner side of the second section. In certain embodiments, the first section further includes alignment sockets on its inner side and the second section further includes alignment posts on its inner side. Additionally or alternatively, the first section may include an indentation positioned along its perimeter and the second section may include a protrusion positioned along its perimeter.

In step 504, appendages such as arms, legs, and/or hip connector may be attached to or positioned on the first or second section. In one exemplary implementation, a pair of arms and a hip connector are positioned on the first section.

In step 506, the section members of the first and second sections are simultaneously heated. Hot air/gas is blown onto the mating surfaces of the section members until a viscous melt is formed at the top of the section members.

In step 508, the first section and second section are pressed together such that the mating surfaces of the section members bond with each other. In some embodiments, the alignment posts of the second section are also inserted into the alignment sockets of the first section and/or the indentation of the first section engages with the protrusion of the second section. The section members form a permanent bond as they cool and solidify, resulting in the first and second sections being securely coupled to each other to form a body assembly. The attached appendages are also thereby held in position between the first and second sections.

In step 510, a head and/or additional appendages are then coupled to the body assembly to create the toy figurine.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. For example, the method for fabricating the body assembly can also be applied to other body parts and appendages of a toy figurine, as well as other polyolefin-based toy assemblies. For instance, a leg may be similarly fabricated without the use of screws or adhesives by heat welding internal bosses of a first leg section and a second leg section together. Additionally, in some embodiments, the weldable members of the front section and back section may have a different geometry from the tubular bosses described herein. Such weldable members may be used in conjunction with or in the place of the bosses. For example, various combinations of ribs and boxes, bosses and ribs, alignment ribs only, and a perimeter lap joint alone may be used.

Moreover, it is to be understood that terms such as "front," "back," "side," "length," "exterior," "inner," "outer" and the like as may be used herein, merely describe points or portions of reference and do not limit the present invention to any particular orientation or configuration. Further, the term "exemplary" may be used herein to describe an example or illustration. Any embodiment described herein as exemplary is not to be construed as a preferred or advantageous embodiment, but rather as one example or illustration of a possible embodiment of the invention. Finally, various features from one of the embodiments may be incorporated into another of the embodiments.

The invention claimed is:

1. A toy assembly comprising:

a first section including a plurality of first section members positioned on an inner side of the first section and a plurality of alignment sockets on the inner side of the first section; and a second section coupled to the first section, the second section including a plurality of second section members positioned on an inner side of the second section and a plurality of alignment posts on the inner side of the second section, the plurality of alignment posts being received by the plurality of alignment sockets to align the second section with the first section, and the plurality of second section members being heat welded directly to the plurality of first section members without any additional welding material, wherein the first section and the second section are solely held together by the heat welded first section members and second section members.

2. The toy assembly of claim 1, wherein:

the first section includes an indentation positioned along a perimeter of the first section; and the second section includes a protrusion positioned along a perimeter of the second section, the protrusion engaging the indentation to form an overlap joint that aligns the second section with the first section.

3. The toy assembly of claim 1, wherein the plurality of first section members and the plurality of second section members are cylindrically shaped bosses with hollow centers.

4. The toy assembly of claim 1, wherein the toy assembly is completely made of a single polyolefin material and does not include an adhesive or screw.

5. The toy assembly of claim 4, wherein the toy assembly is made of a high-density polyethylene (HDPE).

6. The toy assembly of claim 1, wherein the toy assembly is a body assembly for a toy figurine.

7. The toy assembly of claim 6, further comprising a pair of arms movably retained between the first section and the second section.

8. The toy assembly of claim 6, further comprising:

a hip connector retained between the first section and the second section, the hip connector including a pair of annular ball joints; and a pair of legs, each leg movably coupled to one of the pair of annular ball joints.

9. A body assembly for a toy figurine comprising:

a first section including a plurality of first section bosses and alignment sockets positioned on an inner side of the first section; and a second section coupled to the first section, the second section including a plurality of second section bosses and alignment posts positioned on an inner side of the second section, wherein the plurality of first section bosses are directly heat welded to the plurality of second section bosses without any additional welding material, and the alignment posts are engaged with the alignment sockets but are not heat welded to the alignment sockets.

10. The body assembly of claim 9, wherein:

the first section includes an indentation positioned along a perimeter of the first section; and the second section includes a protrusion positioned along a perimeter of the second section, the protrusion engaging the indentation to form an overlap joint that aligns the second section with the first section.

11. The body assembly of claim 9, wherein the plurality of first section bosses are positioned proximate a perimeter of the first section, and the plurality of second section bosses are positioned proximate a perimeter of the second section.

12. The body assembly of claim 9, wherein at least one of the alignment posts and at least one of the alignment sockets are positioned within an upper portion, a middle portion, and a lower portion of the body assembly.

13. The body assembly of claim 9, wherein the body assembly does not include an adhesive or screw and is completely made of a high-density polyethylene (HDPE).

14. The body assembly of claim 9, further comprising a pair of arms movably retained between the first section and the second section.

15. The body assembly of claim 9, further comprising:

a hip connector retained between the first section and the second section, the hip connector including a pair of annular ball joints; and a pair of legs, each leg movably coupled to one of the pair of annular ball joints.

16. A method of fabricating a toy assembly, the method comprising the steps of:

providing a first section and a second section, the first section having a plurality of first section members and a plurality of alignment sockets positioned on an inner side of the first section, and the second section having a plurality of second section members and a plurality of alignment posts positioned on an inner side of the second section;

heating a top portion of the plurality of first section members and a top portion of the plurality of second section members; and bringing together the first section and the second section by inserting the plurality of alignment posts into the plurality of alignment sockets to align the first section with the second section and heat welding the plurality of first section members to the plurality of second section members to permanently couple the first section to the second section without adhesives or screws.

17. The method of claim 16, wherein:

the first section includes an indentation positioned along a perimeter of the first section;

the second section includes a protrusion positioned along a perimeter of the second section; and the step of bringing together the first section and the second section further includes engaging the indentation with the protrusion to align the first section with the second section.

18. The method of claim 16, wherein the plurality of first section members and the plurality of second section members are cylindrically shaped bosses with hollow centers.

* * * * *